US006027393A

United States Patent [19]

O'Rourke

[11] Patent Number: 6,027,393

[45] Date of Patent: Feb. 22, 2000

[54] RECREATIONAL FOAM FLOAT WITH SQUIRTING DEVICE

[75] Inventor: Thomas J. O'Rourke, Harlingen, Tex.

[73] Assignee: Kidpower, Inc., Brentwood, Tenn.

[21] Appl. No.: 09/134,710

[22] Filed: Aug. 14, 1998

[51] Int. Cl.[7] ..... A63H 23/10; B63C 9/08

[52] U.S. Cl. ..... 446/153; 222/78; 239/211; 239/289; 441/132; 441/136

[58] Field of Search ..... 222/78, 79; 239/211, 239/289; 441/88, 129, 132, 136; 446/153

[56] References Cited

U.S. PATENT DOCUMENTS

| | | | |
|---|---|---|---|
| D. 316,586 | 4/1991 | Tager et al. | D21/237 |
| 4,925,181 | 5/1990 | Anderson | 446/153 X |
| 4,932,912 | 6/1990 | Combs | 441/129 |
| 5,009,413 | 4/1991 | Allen | 446/153 X |
| 5,167,554 | 12/1992 | Tager et al. | 441/129 X |
| 5,233,705 | 8/1993 | Coleman et al. | 441/129 X |

*Primary Examiner*—John A. Ricci
*Attorney, Agent, or Firm*—Lucian Wayne Beavers Waddey & Patterson

[57] ABSTRACT

A water toy apparatus includes an elongated buoyant torso having first and second ends. A head is defined on the first end of the torso. First and second arms are connected to an intermediate location on the torso. The first and second arms include first and second manually squeezable pump bulbs each of which has an inlet and an outlet. A discharge conduit has a first end communicated with the outlets of the first and second pump bulbs, and has a second end terminating in the head, so that upon squeezing the pump bulbs water is squirted out of the head.

16 Claims, 3 Drawing Sheets

RECREATIONAL FOAM FLOAT WITH SQUIRTING DEVICE

BACKGROUND OF THE INVENTION

The present invention relates generally to water toys, and more particularly to water toys having a fluid squirting device incorporated therein.

It is commonly known that children enjoy a myriad of activities associated with water play that include the use of flotation devices, water toys, water pistols and guns, sprinklers and the like. Accordingly, water floats that consist of an elongated, flexible foam member, such as those marketed and sold by Kidpower, Inc. under the FUNNOODLE™ brand name, have become very popular. Such floats can be used singularly or connected together to form a variety of useful water toys. Further, netting or material can be connected to the cylindrical pieces to form chairs, lounges and the like. A variation of the cylindrical foam float includes ornamentation to make the float resemble an animal, such as a pony.

One example of a prior art floating apparatus including a squirting device is shown in U.S. Pat. No. Des. 316,586 to Tager. However, that device utilizes a conventional toroidal inner tube shape.

None of the pool and water toys described above incorporate the features of an elongated foam water float and a water squirting toy.

SUMMARY OF THE INVENTION

A water toy apparatus is provided including an elongated buoyant member having first and second ends and having a length defined between the first and second ends. The buoyant member has a flow path defined therethrough. The flow path includes a suction inlet positioned at an intermediate location along the length of the buoyant member, and includes an outlet positioned remote from the inlet. A manual pump chamber is disposed in the flow path. A one-way valve is disposed in the flow path between the suction inlet and the pump chamber. Upon squeezing the pump chamber water is forcibly expelled from the outlet and upon releasing the pump chamber water is drawn through the suction inlet and into the pump chamber. The invention may be embodied in a water toy having the appearance of a toy dragon wherein the pump chambers are manual pump bulbs which form the arms of the dragon. When a child sits astride the floating toy, the arms, including the pump chambers, are held below the water level. Upon squeezing the arms of the toy the child may squirt water from the head of the toy.

It is therefore the general of the present invention to provide an improved water toy apparatus.

Another object of the present invention is the provision of a water toy apparatus which resembles a toy dragon and which squirts water from the dragon's mouth.

Still another object of the present invention is the provision of methods of operating such a water toy apparatus.

Other and further objects, features and advantages of the present invention will be readily apparent to those skilled in the art upon the reading of the following disclosure when taken in conjunction with the accompanying drawings.

DETAILED DESCRIPTION OF THE PREFERRED EMBODIMENTS

Turning now to the drawings, a water toy apparatus is shown and generally designated by the numeral 10. The apparatus 10 includes an elongated buoyant member 12 having first and second ends 14 and 16 and having a length defined between the first and second ends 14 and 16.

Figure 1:
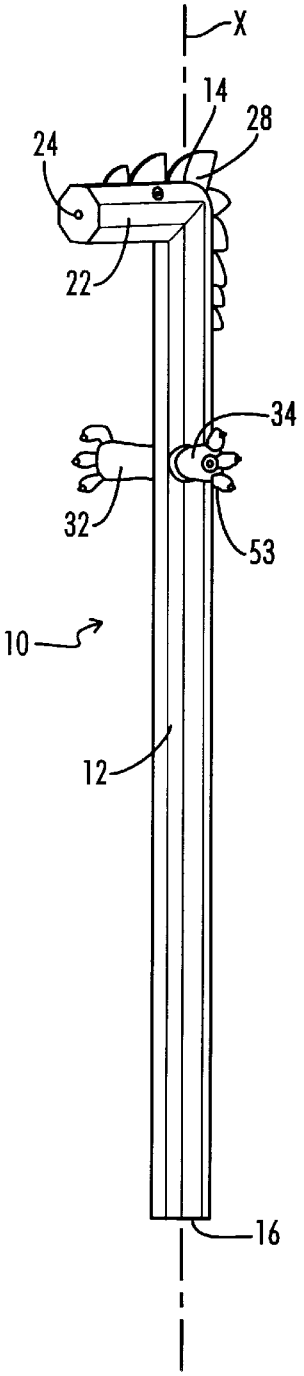
FIG. 1 is an elevation view of the water toy apparatus, with the elongated body in an extended position.
Figure 2:
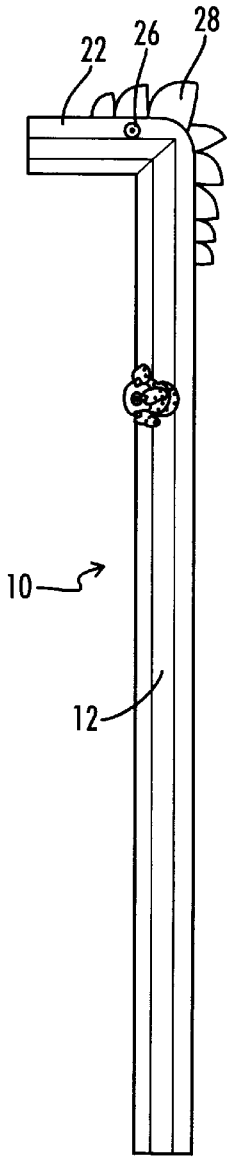
FIG. 2 is an elevation view of the apparatus of FIG. 1 rotated 45 degrees from the view of FIG. 1.
Figure 3:
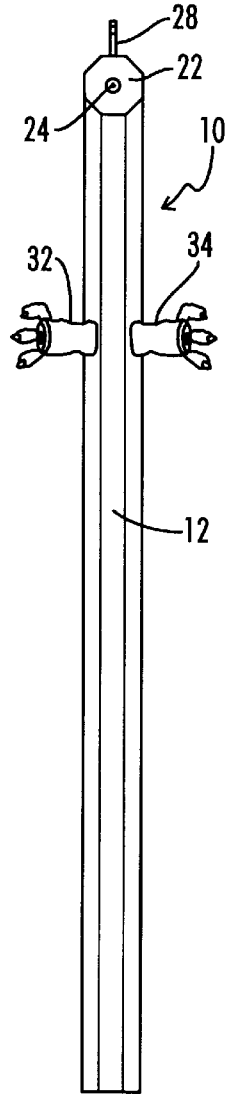
FIG. 3 is a left side elevation view of the apparatus of FIG. 2.
Figure 4:
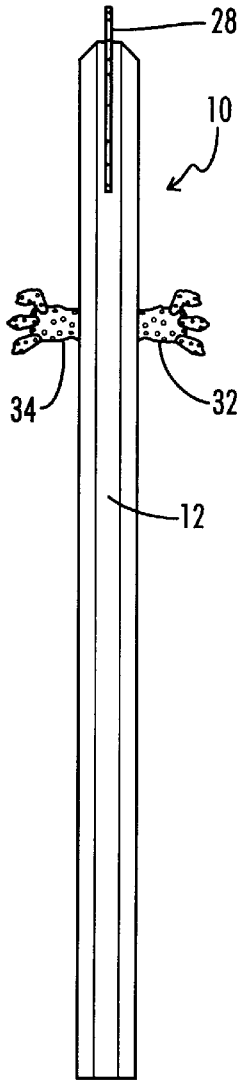
FIG. 4 is a right side elevation view of the apparatus of FIG. 2.
Figure 5:
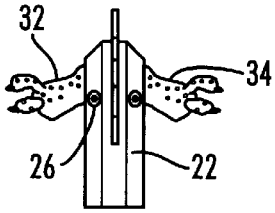
FIG. 5 is a top plan view of the apparatus of FIG. 3.
Figure 6:
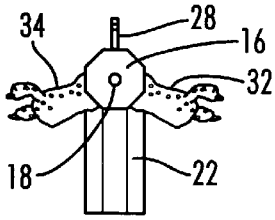
FIG. 6 is a bottom view of the apparatus of FIG. 4.
Figure 7:
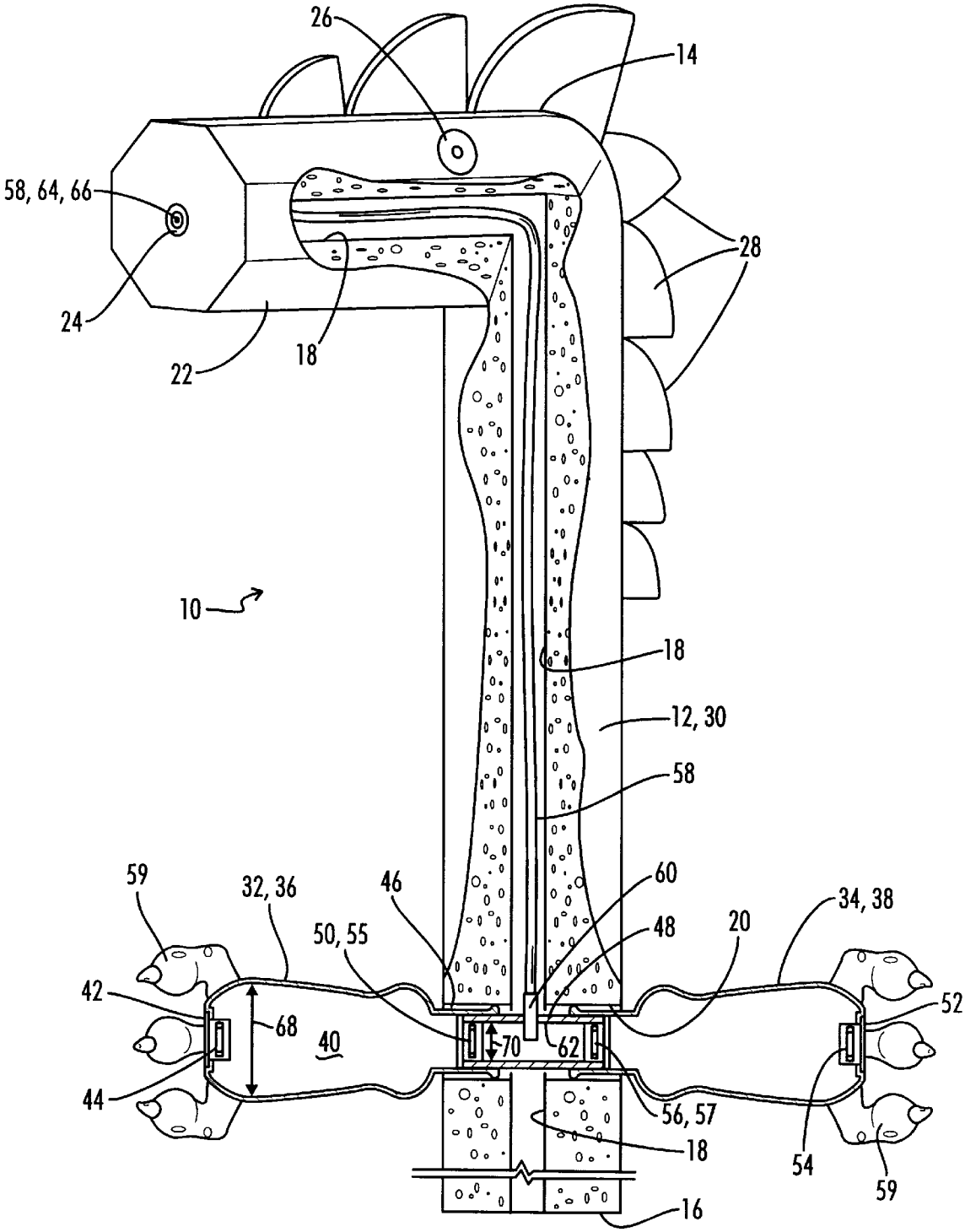
FIG. 7 is an enlarged partly sectioned view of the upper portion of the apparatus of FIG. 1, showing the internal details of the pump chambers, valves and tubing.

As best seen in FIG. 7, the buoyant member 12 has an axial bore or hole 18 defined therethrough. Body 12 also has a transverse bore 20 disposed therethrough which intersects the axial bore 18.

At its upper end 14, the elongated portion of the buoyant member 12 is bent to form a head portion 22 of the water toy. The axial bore 18 is similarly bent and exits at a distal end opening 24 which may also be described as a mouth of the water toy. The axial hole 18 also continues downward through the elongated body 12 to the tail end 16 thereof.

The elongated buoyant member 12 is preferably constructed from a closed cell buoyant foam material.

The body 12 may carry decorative portions such as eyes 26 and spines 28 to create the appearance of a dragon or other mythical creature.

The longer portion of elongated buoyant member 18, which is generally designated by the numeral 30, may be referred to as a torso 30 having the first and second ends 14 and 16, with the head 22 being defined on the first end 14.

The water toy apparatus 10 further includes first and second arms 32 and 34 which are connected to an intermediate location of the torso 30 on opposite sides thereof. The first and second arms 32 and 34 include first and second manually squeezable pump bulbs 36 and 38. As will be further described below, a child sitting astride the toy 10 may grasp the pump bulbs 36 and 38 and squeeze them to squirt water out the mouth 24 of the toy 10.

The pump bulb 36 is a hollow member having a pump chamber 40 defined therein. The bulb 36 is made of a resilient flexible rubber or plastic material, so that after it is squeezed to pump water out of the pump chamber 40, it will quickly snap back to its original shape when released.

The pump bulb 36 has an inlet 42 located on its outer end. Located adjacent to inlet 42 is a first one way check valve 44, which may be referred to as an upstream check valve 44. The check valve 44 will allow water to flow into the pump chamber 40, but not out of the pump chamber 40.

The first arm 32 has a connector tube portion 46 which extends inward from the bulb shape portion 46. The connector tube portion 46 fits tightly about a transverse connector tube 48 which extends through the transverse bore 20 of the elongated body 12.

A downstream check valve 50 is disposed in the connector tube 46 adjacent the first pump chamber 40. Downstream check valve 50 allows fluid to flow out of pump chamber 40 but not into pump chamber 40. The location of downstream check valve 50 may be referred to as an outlet 55 of pump chamber 40.

The second arm 34 is similarly constructed, having an inlet 52, upstream check valve 54, downstream check valve 56 and outlet 57.

The downstream check valves 50 and 56 may be described as being located at the first and second discharge outlets 55 and 57 of pump bulbs 36 and 38. This places the discharge outlets 55 and 57 in fluid communication so that the first and second pump chambers 36 and 38 may be described as being hydraulically in parallel with each other.

Both the arms 32 and 34 include decorative claws 59.

The transverse connector tube 48 extends through the axial hole 18 which extends through the length of the elongated flexible body 12.

A discharge conduit 58 is received in the axial hole 18 between the transverse bore 20 and the mouth 24. The discharge conduit 58 has a first end 60 which is in fluid communication with the inner bore 62 of the transverse tube connector tube 48, thus forming a T-connection. The discharge conduit 58 includes a second end 64 mounted in the mouth 24 of head 22 of the apparatus 10. Preferably a nozzle 66 is mounted in the second end 64 of discharge conduit 58.

Thus it is seen that the discharge conduit 58 is communicated with the outlets of the first and second pump bulbs 36 and 38, and has its second end 64 terminating in the head 22, so that upon squeezing of the pump bulbs 36 and 38, water is squirted out of the head 22.

One important aspect of the water pumping system just described involves the relative cross-sectional areas of the pump chambers 36, 38 as compared to the discharge conduit 58.

In one embodiment, the pump bulbs 36 have a maximum inside diameter 68 in a range of from 1½ to 1⅝ inches, which provides a cross-sectional area of at least about 1.767 square inches. The transverse connector 48 has an inside diameter 70 of approximately ½ inch which provides a cross-sectional area of about 0.196 inches. Discharge tube 58 has an inside diameter of approximately ⅛ inch which provides a cross-sectional area of about 0.012 square inches. The nozzle 66 has an inside diameter of approximately 1/16 inch which provides a cross sectional area of approximately 0.003 square inches. Thus, in general, the pump chamber 36 and 38 can each be described as having a first cross-sectional area which is at least 100 times as great as the cross-sectional area of either the discharge tube 58 or the outlet of nozzle 66. Furthermore, the transverse connector 48 can be described as having a cross-sectional area at least ten times as great as the cross-sectional area of either the discharge tube 58 or the outlet of nozzle 66.

The large cross-sectional area of the pump bulbs relative to the nozzle outlet allows a child to squirt water large distances, up to twenty feet.

The elongated buoyant member 12 can be described as having a flow path defined therethrough. That flow path includes the suction inlets 42 and 52 defined in the arms 32 and 34, and includes the outlet in nozzle 66. The flow path flows through the pump bulbs 36 and 38, the transverse connector tube 46, the discharge tube 58 and the nozzle 66.

The first and second pump bulbs 36 and 38 may each be described as a manual pump chamber disposed in the flow path.

The upstream check valves 44 and 54 may each be described as one way valve disposed in the flow path between the suction inlet and the pump chamber for allowing water to flow through the suction inlet into the pump chamber when the suction inlet is submerged in a body of water and for preventing backflow out of the suction inlet.

Figure 8:
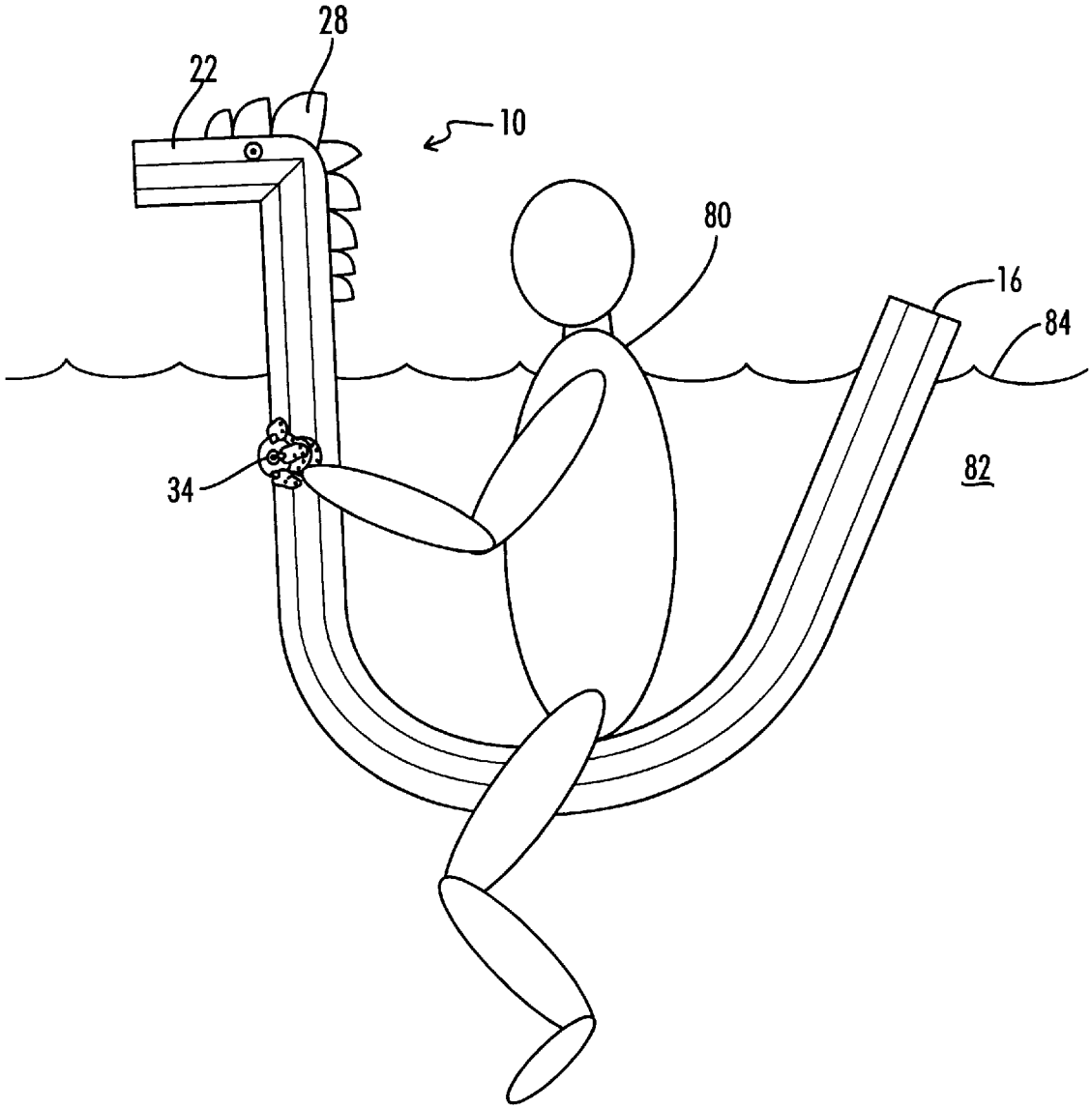
FIG. 8 is a schematic illustration showing a child sitting astride a water toy within a body of water.

As is schematically illustrated in FIG. 8, the arms 32 and 34 are located at a location along the length of the buoyant member 12 so that a human child 80 may sit astride the elongated torso 30 and grip the arms 32 and 44, with the arms 32 and 34 being submerged within a body of water 82 below the surface 84 thereof, and with the head 22 of the buoyant member 12 extending above the body of water 82.

The T-connection, formed by transverse connector tube 48 and discharge tube 58, is downstream of the first and second discharge outlets 55 and 57 and has a cross-sectional area at least ten times as great as the cross-sectional area of either the discharge conduit 58 or nozzle 66.

OPERATION

In reference to FIG. 8 it will be apparent that the recreational water toy apparatus 10 may be operated in the following manner.

First the water toy 10 is provided having the elongated buoyant member 12, a flow path defined through the buoyant member with inlets such as 42 and 52, and with an outlet such as 66 at the other end of the flow path. A manual pump chamber such as either 36 or 38 is disposed in the toy and communicated with the flow path.

A human child 80 is supported upon the elongated buoyant flexible member 12 in a body of water 82 so that the inlets 42 and 52 are submerged in the body of water 82 and the outlet 66 is located above the body of water 82.

Then upon squeezing the manual pump chambers 36 and 38 water is squirted out the outlet 66.

During the squeezing of the manual pump chamber backflow of water out the inlets 42 and 52 is prevented by the upstream check valves 44 and 54.

After squeezing the pump chambers to squirt water, the pump chambers are released, thus drawing water back through the inlets 42 and 52 from the body of water 82 to refill the pump chambers 36 and 38.

The arms 32 and 34 also serve as hand grips, with the pump chambers 36 and 38 being disposed in the hand grips.

Thus it is seen that the apparatus and methods of the present invention readily achieved the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed:

1. A water toy apparatus, comprising:

an elongated buoyant member having first and second ends and having a length defined between the first and second ends, the buoyant member having a flow path defined therethrough, the flow path including a suction inlet positioned at an intermediate location along the length of the buoyant member and an outlet positioned remote from the inlet;

a manual pump chamber disposed in the flow path;

a one-way valve disposed in the flow path between the suction inlet and the pump chamber, for allowing water to flow through the suction inlet into the pump chamber when the suction inlet is submerged in a body of water and for preventing flow back out of the suction inlet; and whereby upon squeezing of the pump chamber, water is forcibly expelled from the outlet, and upon releasing the pump chamber water is drawn through the suction inlet and into the pump chamber;

wherein:

the buoyant member includes an elongated torso, a head, and at least one arm;

the manual pump chamber is located in the arm;

the suction inlet is located in the arm; and the outlet is located in the head.

2. The apparatus of claim 1, wherein;

the buoyant member includes a second arm and the flow path includes a second suction inlet located in the second arm; and the apparatus further includes a second pump chamber located in the second arm, and a second one-way valve disposed in the flow path between the second suction inlet and the second pump chamber.

3. The apparatus of claim 2, wherein:

the first and second arms are located on opposite sides of the torso at a common location along the length of the elongated buoyant member, so that a human child may sit astride the elongated torso and grip the arms of the water toy apparatus with the arms being submerged in the body of water and the head of the buoyant member extending above the body of water.

4. The apparatus of claim 2, wherein:

the first and second pump chambers have first and second discharge outlets, respectively, the first and second discharge outlets being in fluid communication so that the first and second pump chambers are hydraulically in parallel with each other.

5. The apparatus of claim 4, further comprising:

a T-connection, defined in the flow path, downstream of the first and second discharge outlets, the flow path having a first cross-sectional area between the pump chambers and the T-connection and a second cross-sectional area downstream of the T-connection, the first cross-sectional area being at least ten times greater than the second cross-sectional area.

6. The apparatus of claim 5, wherein:

the flow path downstream of the T-connection is defined by a flexible tube disposed through the buoyant member generally parallel to the length of the buoyant member.

7. The apparatus of claim 1, wherein:

the manual pump chamber includes a resilient flexible bulb.

8. The apparatus of claim 7, further comprising:

a second one-way valve disposed in the flow path downstream of the manual pump chamber.

9. The apparatus of claim 7, wherein:

the bulb has a first cross sectional area;

the outlet of the flow path has a second cross-sectional area;

and the first cross sectional area is at least one hundred times as great as the second cross-sectional area.

10. A water toy apparatus, comprising:

an elongated buoyant torso having first and second ends;

a head defined on the first end of the torso;

first and second arms connected to an intermediate location of the torso, the first and second arms including first and second manually squeezable pump bulbs each of which has an inlet and an outlet; and a discharge conduit having a first end communicated with the outlets of the first and second pump bulbs, and having a second end terminating in the head, so that upon squeezing the pump bulbs water is squirted out of the head.

11. The apparatus of claim 10, further comprising:

a connector tube extending transversely through the torso at the intermediate location;

the first and second squeezable pump bulbs being connected to opposite ends of the connector tube; and the discharge conduit being connected to the connector tube to form a T-connection.

12. The apparatus of claim 11, wherein:

the torso has an axial hole defined therethrough from the intermediate location to the head; and the discharge conduit is received in the axial hole.

13. The apparatus of claim 11, wherein:

the connector tube has a first cross-sectional area; and the discharge tube has a second cross-sectional area, the first cross-sectional area being at least ten times as great as the second cross-sectional area.

14. The apparatus of claim 10, further comprising:

first and second upstream check valves located at the inlets of the first and second pump bulbs, respectively.

15. The apparatus of claim 14, further comprising:

first and second downstream check valves located at the outlets of the first and second pump bulbs, respectively.

16. A method of operating a water toy comprising:

(a) providing a water toy having an elongated flexible buoyant member, a head portion, first and second arms which serve as handgrips, a flow path defined through the buoyant member with an inlet at one end of the flow path and an outlet at the other end of the flow path in the head portion, and a manual pump chamber disposed in each arm of the toy and communicated with the flow path;

(b) supporting a human upon the elongated flexible buoyant member in a body of water so that the inlet is submerged in the body of water and the outlet is located above the body of water, with the human astride the elongated flexible buoyant member with the human gripping the handgrips and with the head portion of the water toy extending above the body of water;

(c) squeezing the manual pump chamber to squirt water out of the outlet in the head portion;

(d) during step (c), preventing backflow of water out of the inlet;

(e) releasing the manual pump chamber; and (f) drawing water through the inlet to refill the manual pump chamber.

* * * * *